US006699379B1

(12) United States Patent
Ke et al.

(10) Patent No.: US 6,699,379 B1
(45) Date of Patent: Mar. 2, 2004

(54) METHOD FOR REDUCING STRESS IN NICKEL-BASED ALLOY PLATING

(75) Inventors: Shih-Tsung Ke, Tai Nan Hsien (TW); Jen-Chih Li, Sanchung (TW); Ming-Der Ger, Tao Yuan Hsien (TW); Le-Min Wang, Tao Yuan Hsien (TW); Yeh Sung, Chung Li (TW); Jauh-Jung Yang, Taipei (TW); Ya-Ru Huang, Hsinchuang (TW)

(73) Assignee: Industrial Technology Research Institute, Hsinchu Hsien (TW)

( * ) Notice: Subject to any disclaimer, the term of this patent is extended or adjusted under 35 U.S.C. 154(b) by 0 days.

(21) Appl. No.: 10/302,844

(22) Filed: Nov. 25, 2002

(51) Int. Cl.[7] ..... C25D 15/00

(52) U.S. Cl. ..... 205/109; 205/224; 205/227; 205/255; 205/259; 205/271

(58) Field of Search ..... 205/109, 224, 205/227, 255, 259, 271

(56) References Cited

U.S. PATENT DOCUMENTS 5,266,181 A * 11/1993 Matsumura et al. ..... 205/109
5,853,556 A * 12/1998 Wieczerniak ..... 205/101
6,045,682 A * 4/2000 Rodriguez ..... 205/255

* cited by examiner

*Primary Examiner*—Robert R. Koehler
(74) *Attorney, Agent, or Firm*—Rabin & Berdo, P.C.

(57) ABSTRACT

An improved plating method in combination with a low-temperature thermal treatment is disclosed. The method for reducing the stress in the nickel-based alloy plating comprises the steps of: (a) adding ceramic particles into a plating bath containing soluble nickel salts; and (b) placing a substrate in the plating bath and thereafter carrying out a pulse-current electroplating in the plating bath. The method of this invention can prevent substrate softening or deformation problems. The use of a post low-temperature thermal treatment can slightly increase the hardness of the coating products. The use of the low-temperature thermal treatment can reduce the stress of the coatings since the hydrogen embrittlement resulting from exist of hydrogen in the coatings is eliminated.

11 Claims, 4 Drawing Sheets

METHOD FOR REDUCING STRESS IN NICKEL-BASED ALLOY PLATING

BACKGROUND OF THE INVENTION

1. Field of the Invention

The present invention relates to a method for reducing stress in a nickel-based alloy plating, and in particular, a method to plate a nickel-based alloy (such as Ni-W alloy or Ni-P alloy) having reduced stress by adding ceramic particles into the bath consisting of nickel/tungsten ion solution or nickel/phosphorous ion solution, in combination with the use of pulse current plating and the use of low temperature treatment.

2. Description of the Prior Art

Nickel alloys electroplated for engineering applications include nickel-tungsten, nickel-phosphorous, nickel-cobalt, nickel-manganese and so on. Among these nickel-based alloys, nickel-tungsten alloys particularly have improved resistance to sulfur embrittlement when heated. It has been found that after one hour, 600° C. heat treatment, the hardness of nickel-tungsten alloy coating can reach 1000 Hv or even higher. In addition, coatings of nickel-tungsten show high resistance to corrosion. Accordingly, nickel-tungsten alloys are widely used in various industries such as the automobile industry, aerospace industry, food industry, printing applications, petrochemical/chemical industries, salt making industry, and medical industry. By way of example, the nickel-tungsten alloys may be applied on cylinders, pistons, rotors, compressors, rollers, molding parts, vessels, screens of centrifuges, or parts that are subject to strict corrosive environments.

Tungsten and phosphorous are typically used to increase the hardness and strength of nickel plating. It is known that as the concentration of tungsten in a nickel-tungsten alloy coating gets higher, the hardness and abrasion resistance thereof get better. However, on the other hand, as the concentration of tungsten in a nickel-tungsten alloy coating gets higher, the stress of the coating also raises. A thick nickel-tungsten coating having high stress results in cracking problems and poor adhesion ability. Therefore, researchers have strived to reduce the stress in nickel-tungsten alloy coatings. So far, there are generally two ways to reduce the stress of nickel-tungsten coatings. One approach is disclosed in both U.S. Pat. No. 5,853,556 and U.S. Pat. No. 6,045,682. They both use organic additives as a stress release agent. This has a drawback in that the organic compounds added in the bath will decompose due to the interaction of the electric field, thus generate a great deal of reaction byproducts, thereby deteriorating the coating. To remove the undesired reaction byproducts, active carbon or the like is added into the bath from time to time. This increases the loading of the bath management. In addition, the stress release agent may cause coating structure alterations and affecting the mechanical properties such as hardness of the coating. Another prior art method to reduce the stress of the nickel-tungsten coatings is so-called pulse-current electroplating. However, this pulse-current method is still not perfect.

The pulse-current electroplating is typically carried out by applied a pulse on the bath during plating process. The pulse output, which is somewhat similar to AC current, is preferably an asymmetric wave pulse. Particular parameters regarding the pulse-current electroplating process include On-Time (Ton), Off-Time (Toff), Duty cycle (=(Ton)/(Ton+Toff)), frequency (=1/(Ton+Toff)), and peak current density, and so on.

Furthermore, in order to increase the hardness of the nickel-tungsten coatings, the coatings are typically treated at 600° C. for about one hour. This thermal treatment can bring out $Ni_4W$, which is the main component that improves the material hardness up to 1000 Hv. However, the heat treatment also causes some reverse effects such as substrate softening or deformation, or, in a worse case, stripping of coating from the substrate.

Accordingly, there is a strong need for an improved plating method which is inexpensive and have good reliability and efficiency, and is capable of solving the above-mentioned problems.

SUMMARY OF THE INVENTION

The main objective of the claimed invention is to provide an improved plating method to reduce the stress of the nickel-based coatings such as nickel-tungsten coating and produce crack-free coatings without affecting the hardness of the coatings. According to the present invention, ceramic particles such as silicon carbide particles or tungsten carbide particles are added and evenly distributed in the nickel-tungsten coating.

Another objective of the claimed invention is to provide an improved plating method in combination with a low-temperature thermal treatment, thereby preventing substrate softening or deformation problems. The use of the low-temperature thermal treatment can slightly increase the hardness of the coating products. The use of the low-temperature thermal treatment can reduce the stress of the coatings since the hydrogen embrittlement resulting from exist of hydrogen in the coatings is eliminated.

The above object will be achieved by the method for reducing the stress in the nickel-based alloy plating provided in the present invention, which comprises the steps of: (a) adding ceramic particles into a plating bath containing soluble nickel salts; and (b) placing a substrate in the plating bath and thereafter carrying out a pulse-current electroplating in the plating bath.

Other objects, advantages and novel features of the invention will become more clearly and readily apparent from the following detailed description when taken in conjunction with the accompanying drawings.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DETAILED DESCRIPTION OF THE PREFERRED EMBODIMENT

Figure 1:
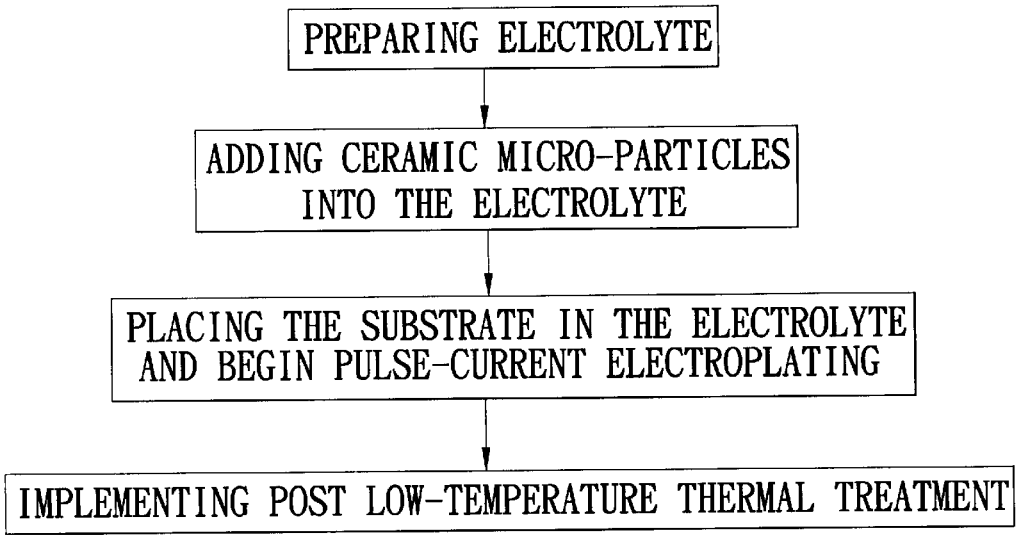
FIG. 1 is a flowchart demonstrating a plating method for reducing the stress of nickel-based coatings according to the present invention.

Now, one embodiment of the present invention will be explained below with reference to the drawings. In accordance with the broad aspects of the present invention, a method for reducing the stress of a nickel-based coating (such as a nickel-tungsten coating) is provided. The method includes the use of ceramic particles such as carbide, metal nitride, or metal oxide, etc., which is timely added into the bath. The method further involves the use of the pulse-current electroplating technique and the use of low-temperature thermal post treatment.

In accordance with the present invention, an electrolyte including nickel slats such as nickel sulfate salts or nickel sulfamate salts and tungsten salts such as sodium tungstate salts is prepared. The electrolyte of this invention contains a nickel ion concentration ranging from about 0.1 M/L to about 0.5 M/L and a tungsten ion concentration preferably ranging from about 0.2 M/L to about 0.5 M/L. Complexing agents useful in the present invention include those commonly used in other electroplating electrolytes, such as citrates, gluconates, tartrates and other alkyl hydroxy carboxylic acids. Generally, these complexing agents are used .in amounts of from about 0.2 M/L to about 0.6 M/L. In a preferred electrolyte of the present invention, a source of ammonium ions such as ammonium chloride is provided in addition to one or more of the above complexing agents. It is understood that the source of ammonium ions stimulates plating of tungsten from the bath and helps keep the metals in solution during plating. It is also found that the exit of chloride ions in the electrolyte facilitates solving of the nickel anode, thereby help balancing the concentration of nickel ions in the electrolyte. A suggested ammonium chloride concentration is between about 0.5 M/L and about 1.5 M/L. A higher concentration of ammonium chloride is not suggested since high concentration of chloride ions in the electrolyte will cause the increase of stress in the coating. According to the present invention, a best mode of effectively electroplating a nickel-tungsten coating generally includes the following parameters: bath-temperature from 40° C. to 70° C., a pH of from 8 to 10, a pulse current density of from 5 A/dm$^2$ to 30 A/dm$^2$, a duty cycle of from 0.1 to 0.5, and a frequency of from 1 to 1000.

In accordance with the present invention, ceramic micro-particles, which have a particle diameter of from 0.1 to 1.0 micrometers, are added into the bath. Some preferred examples include carbide compounds with a good conductive property. According to one preferred embodiment of this invention, silicon carbide, titanium carbide, or tungsten carbide is used. These ceramic micro-particles are adsorbed on the surface of the cathode electrode. Hydrogen ions can thus discharge at the surf ace of the ceramic particles. Further, these ceramic particles facilitate the-exhaust of hydrogen gas generated during the plating process because these ceramic particles usually protrude from the surface of the cathode and because their poor hydrogen absorption ability and poor hydrogen penetration properties. Accordingly, by using the ceramic particles in the bath, the resulting nickel-based coating has reduced hydrogen absorption and hydrogen penetration, thereby improving the crystal structure of the coating. It is surprisingly found that the stress of a nickel-based coating incorporating with relatively high conductive ceramic particles is much lower than the stress of a nickel-based coating incorporating with relatively low conductive ceramic particles. It is noted that before adding the ceramic particles into the bath, these ceramic particles needs to be pre-treated with 50% in weight hydrochloric acid, at 70° C. for about 15 minutes, followed by clean water rinse. Generally, the concentration of the ceramic particles in the bath is from about 1 g/L to about 50 g/L.

In accordance with the present invention, the low-temperature thermal treatment is carried out in a furnace. To promote the hardness of the coatings, the thermal treatment has to be went through different temperature stages (such as 200° C., 300° C., 400° C. ) for corresponding time periods respectively. By doing this, the substrate deformation can be avoided. During the thermal treatment, a heating rate between two temperature stages is preferably about 5° C./sec. Further, to obtain good uniformity of the coatings among different batches, the temperature precision has to be controlled within the range of ±5° C.

Figure 2:
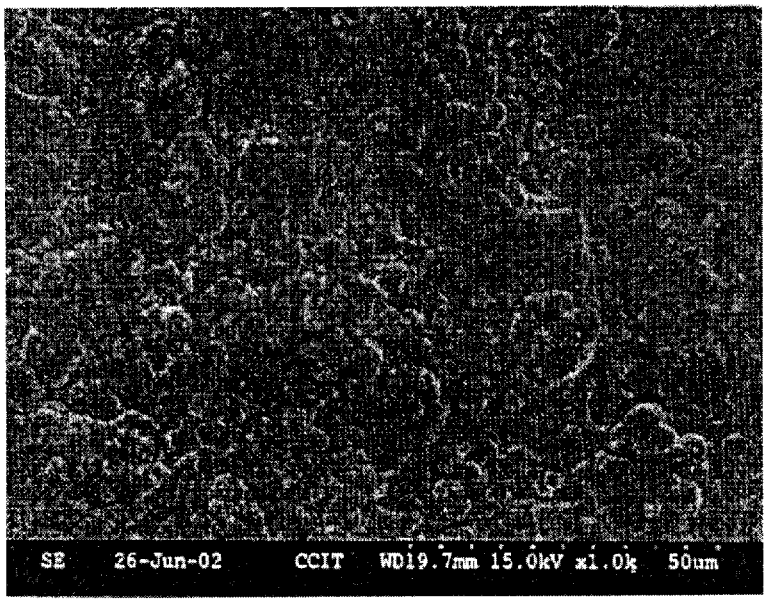
FIG. 2 is an electron microscopy picture (×1000) showing a part of a nickel-based coating fabricated by using the plating method for reducing the stress of nickel-based coatings according to the present invention.

Referring to FIG. 1, a first preferred embodiment of this invention is illustrated in the form of a flowchart. The electroplating method for reducing the stress of nickel-based coatings according to the present invention includes: preparing an electrolyte containing 25~35 g nickel sulfate salt, 130~150 g sodium tungstate salt, 100~120 g sodium citrate salt, and 20~30 g ammonium chloride salt. The bath is adjusted to maintained at a pH of from 9 to 10. Thereafter, 10~20 g silicon carbide micro-particles are added into the bath. Preferably, these micro-particles are dispensed in the bath by a mixing means known in the art. Meanwhile, the concentration of the nickel ion in the electrolyte is about 0.10~0.23 M/L, the concentration of the tungsten ion in the electrolyte is about 0.34~0.49 M/L, the concentration of the sodium citrate in the electrolyte is about 0.39~0.47 M/L, the concentration of the ammonium chloride in the electrolyte is about 0.5~0.7 M/L, and the concentration of the silicon carbide in the electrolyte is about 10~20 g/L. A piece of cleaned iron is then placed in the bath having the above-mentioned concentration conditions, and a pulse-current electroplating process begins. The current density is adjusted to 12.5 A/dm$^2$, the duty cycle is 0.2, and the frequency is 1000 Hz. An enlarged view (×1000) of an electron microscopy picture of the nickel-tungsten coating is shown in FIG. 2. The resulting nickel-tungsten coating (100 $\mu$m thick) has a superior hardness of 792 Hv and a stress of 21 kg/mm$^2$.

Figure 3:
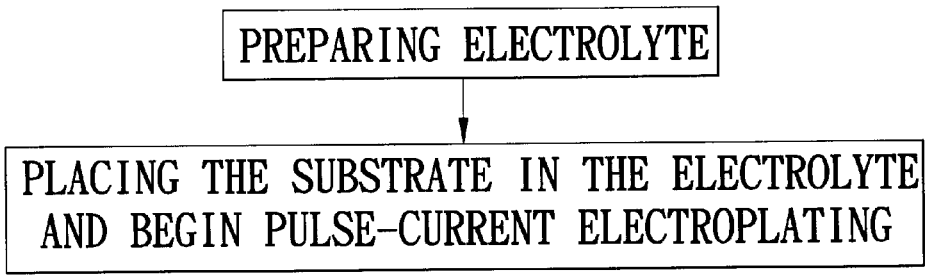
FIG. 3 PRIOR ART
FIG. 3 is a flowchart demonstrating a conventional method according to the prior art.
Figure 4:
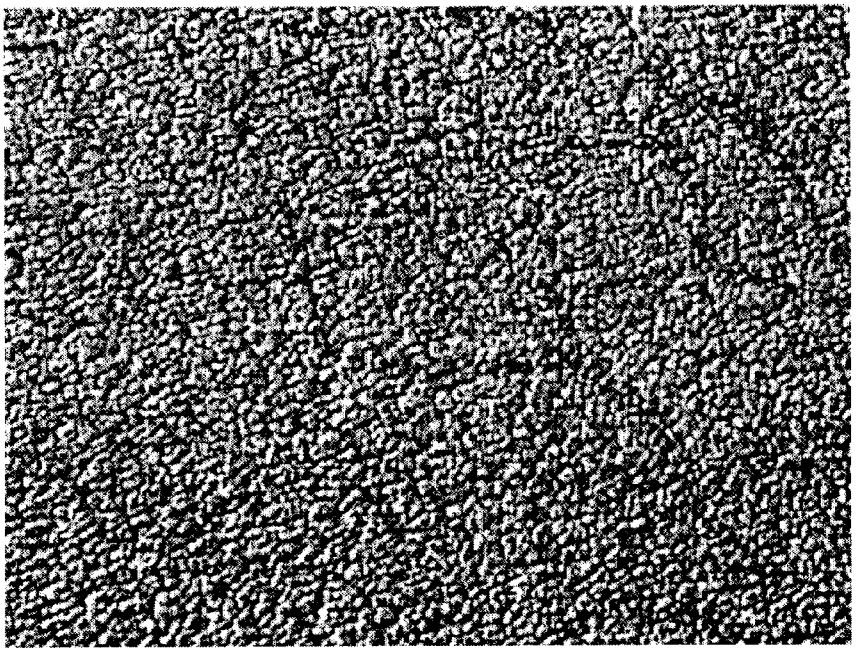
FIG. 4 PRIOR ART
FIG. 4 is an electron microscopy picture (×100) showing a part of a nickel-based coating fabricated by using the conventional-method according to the prior art.

Referring to FIG. 3, a prior art method is also illustrated in the form of a flowchart in comparison with the present invention. As shown in FIG. 3, according to the prior art method, only the pulse-current electroplating is used. The prior art method includes: preparing an electrolyte containing 25~35 g nickel sulfate salt, 130~150 g sodium tungstate salt, 100~120 g sodium citrate salt, and 20~30 g ammonium chloride salt. The bath is adjusted to maintained at a pH of from 9 to 10. The concentration of the nickel ion in the electrolyte is about 0.10~0.23 M/L, the concentration of the tungsten ion in the electrolyte is about 0.34~0.49 M/L, the concentration of the sodium citrate in the electrolyte is about 0.39~0.47 M/L, the concentration of the ammonium chloride in the electrolyte is about 0.5~0.7 M/L. A piece of cleaned iron is placed in the bath having the above-mentioned concentration conditions, and a pulse-current electroplating process begins. The current density is adjusted to 12.5 A/dm$^2$, the duty cycle is 0.2, and the frequency is 1000 Hz. An enlarged view (×100) of an electron microscopy picture of the nickel-tungsten coating fabricated by using the above-mentioned prior art method is shown in FIG. 4. The resulting nickel-tungsten coating (100 $\mu$m thick) has a superior hardness of 745 Hv and a stress of 42 kg/mm$^2$.

To sum up, the present invention provides a method for reducing stress in a nickel-based alloy plating and improving the hardness of the coating. The method of this invention can electroplate a nickel-based alloy having reduced stress by adding ceramic particles into the bath consisting of nickel/ tungsten electrolyte or nickel/phosphorous electrolyte, in-combination with the use of pulse current plating and the use of low-temperature treatment.

Those skilled in the art will readily observe that numerous modification and alterations of the device may be made while retaining the teachings of the invention. Accordingly, the above disclosure should be construed as limited only by the metes and bounds of the appended claims.

What is claimed is:

1. A method for reducing stress in a nickel-based alloy plating, comprising:

adding ceramic micro-particles into an electrolyte at least containing soluble nickel salt; and placing a substrate in the plating bath and thereafter carrying out a pulse-current electroplating.

2. The method as claimed in claim 1 wherein the concentration of the nickel salt is about 0.1~0.5 M/L.

3. The method as claimed in claim 2 wherein the nickel salt is one of nickel sulfate and nickel sulfamate.

4. The method as claimed in claim 1 wherein the electrolyte further contains 0.2~0.5 M/L tungsten salt, 0.2~0.6 M/L complexing agent, and 0.3~1.5 M/L ammonium chloride.

5. The method as claimed in claim 4 wherein the tungsten salt is sodium tungstate.

6. The method as claimed in claim 4 wherein the complexing agent comprises at least one of citrates, gluconates, tartrates and alkyl hydroxy carboxylic acids.

7. The method as claimed in claim 1 wherein the ceramic micro-particles comprise at least one of carbide, metal nitride, and metal oxide.

8. The method as claimed in claim 7 wherein, the carbide comprises at least one of silicon carbide, tungsten carbide, and titanium carbide.

9. The method as claimed in claim 1 wherein the ceramic micro-particles have a diameter of about 0.1~1.0 micrometers.

10. The method as claimed in claim 1 wherein during the pulse-current electroplating, the current density is 5~30 $A/dm^2$, duty cycle is 0.1~1.5, and the pulse frequency is 1~1000 Hz.

11. The method as claimed in claim 1 further comprising a low-temperature thermal treatment after the pulse-current electroplating.

* * * * *